US006351068B2

(12) United States Patent
Yamazaki et al.

(10) Patent No.: US 6,351,068 B2
(45) **Date of Patent: *Feb. 26, 2002**

(54) TRANSPARENT CONDUCTIVE LAMINATE AND ELECTROLUMINESCENCE LIGHT-EMITTING ELEMENT USING SAME

(75) Inventors: Fumiharu Yamazaki; Tomoyuki Okamura; Shin Fukuda, all of Kanagawa-ken; Nobuhiro Fukuda, Yamaguchi-ken, all of (JP)

(73) Assignee: Mitsui Chemicals, Inc. (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/766,824

(22) Filed: Dec. 13, 1996

(30) Foreign Application Priority Data

| | | |
|---|---|---|
| Dec. 20, 1995 | (JP) | 7-331379 |
| Feb. 14, 1996 | (JP) | 8-027005 |
| Feb. 15, 1996 | (JP) | 8-027651 |
| Feb. 20, 1996 | (JP) | 8-032015 |

(51) Int. Cl.[7] ..... H05B 33/28

(52) U.S. Cl. ..... 313/506; 428/917

(58) Field of Search ..... 313/506, 512; 428/323, 328, 325, 329, 477.7, 689, 917, 411.1

(56) References Cited

U.S. PATENT DOCUMENTS

| | | | |
|---|---|---|---|
| 3,564,260 | A | 2/1971 | Tanaka |
| 4,527,096 | A | 7/1985 | Kindlmann |
| 5,225,273 | A | 7/1993 | Mikoshiba et al. |

FOREIGN PATENT DOCUMENTS

| | | |
|---|---|---|
| JP | 1-100260 | 4/1989 |

(List continued on next page.)

OTHER PUBLICATIONS

Chemical Abstracts, vol. 104, No. 20, May 19, 1986, Columbus, OH, Abstract No. 178340, Mikoshiba, Hitoshi et al, "Transparent Conductive Films Prepared by D.C. Magnetron Sputtering", XP002037738 *Abstract* & Nippon Kagaku Kaishi (1986), (3), 255–60, Coden: NKAKB8; ISSN: 0369–4577, 1986.

(List continued on next page.)

*Primary Examiner*—Ashok Patel
(74) *Attorney, Agent, or Firm*—Burns, Doane, Swecker, & Mathis, L.L.P.

(57) ABSTRACT

A transparent conductive laminate in which a transparent conductive layer (an ITO film) mainly comprising indium, tin and oxygen is formed on one main surface of a transparent substrate such as a polymeric film and which is excellent in moist heat resistance and scuff resistance and which can be applied to various kinds of transparent electrodes. The transparent conductive layer has a stable amorphous structure, and its resistivity is $1\times10^{-2}$ Ω·cm or less, and its electron mobility is 20 $cm^2/(V\cdot sec)$ or more. This transparent conductive laminate can be prepared by forming an amorphous film mainly comprising indium, tin and oxygen and having a resistivity of more than $1\times10^{-2}$ Ω·cm on the substrate by a sputtering process under a high oxygen concentration atmosphere, and then subjecting the film to a heat treatment in the range of 80 to 180° C. to decrease the resistivity to $1\times10^{-2}$ Ω·cm or less, while the amorphous structure is maintained. This transparent conductive laminate can suitably be utilized as the transparent electrode of an electroluminescence light-emitting element equipped with a layer containing zinc sulfide as a light-emitting layer, and in this case, the deterioration of luminance during continuous light emission can be remarkably inhibited.

18 Claims, 6 Drawing Sheets

FOREIGN PATENT DOCUMENTS

| | | |
|---|---|---|
| JP | 1-145325 | 6/1989 |
| JP | 2-194943 | 8/1990 |
| JP | 2-257591 | 10/1990 |
| JP | 2-276630 | 11/1990 |
| JP | 3-36703 | 2/1991 |
| JP | 3-15536 | 3/1991 |

OTHER PUBLICATIONS

Bellingham Jr., et al, "Amorphous Indium Oxide", Thin Solid Films, vol. 195, No. 1/02, Jan. 1, 1991, pp. 23–31, XP000177075.

Minami et al, "Physics of Very Thin Ito Conducting Films With High Transparency Prepared by DC Magnetro Sputtering", Thin Solid Films, vol. 270, No. 1/20, Dec. 1, 1995, pp. 37–42, XP000595205.

TRANSPARENT CONDUCTIVE LAMINATE AND ELECTROLUMINESCENCE LIGHT-EMITTING ELEMENT USING SAME

BACKGROUND OF THE INVENTION (i) Field of the Invention

The present invention relates to a transparent conductive laminate in which a transparent conductive a film mainly comprising tin, indium and oxygen is formed on a transparent substrate, and more specifically, it relates to a transparent conductive laminate using an amorphous film as a transparent conductive film and having excellent moist heat resistance and scuff resistance, and an electroluminescence (EL) light-emitting element using this transparent conductive laminate.

(ii) Description of the Prior Art

In recent years, devices and equipments regarding optical electronics have remarkably progressed and prevailed with the increasing demand of information in society. In such circumstance, transparent conductive laminates have widely been used as electrodes of I/O devices such as transparent touch panels, electrodes of display devices such as liquid crystal displays, and electroluminescence displays and electrochromic displays. Further, they have been uses as window electrodes of photoelectric conversion elements such as solar batteries and the like, and electromagnetic shielding films of electromagnetic wave shields.

The transparent conductive laminate is usually constituted of a transparent substrate and a transparent conductive layer formed thereon. Examples of the transparent conductive layer include metallic thin films of gold, silver, platinum, palladium and the like, oxide semiconductor thin films of indium oxide, tin (IV) oxide, zinc oxide and the like, and multi-layer thin films comprising a laminate of a metallic oxide and a metal. The metallic thin films are excellent in conductivity but poor in transparency. On the contrary, the oxide semiconductor thin films are slightly poor in conductivity in general but excellent in transparency. Of these oxide semiconductor thin films, the thin films comprising indium, tin and oxygen, which are also called ITO (indium tin oxide) films, are excellent in conductivity and transparency, and in addition, and can easily be formed into electrode patterns by etching. For these features, the ITO films have widely been utilized. The resistivity and the light transmittance of the ITO films are usually in the range of about $5\times10^{-5}$ to $1\times10^{-3}$ $\Omega\cdot$cm and in the range of 80 to 90%, respectively.

As factors for the performance evaluation of the transparent conductive laminate, there are chemical stability such as moist heat resistance and physical strength such as scuff resistance in addition to the electric resistance and the light transmittance. With regard to the ITO film formed at a low temperature, its electric resistance usually changes depending on the amount of oxygen in the film, so that the electric resistance noticeably changes by a heat treatment or a moist heat treatment. Accordingly, the thus formed ITO film has the problem of chemical stability. The transparent conductive laminate having the thus formed ITO film is finally used as a transparent electrode of a product such as a liquid crystal display or a transparent touch panel, but in this case, if the performance of the transparent conductive laminate changes, a trouble might occur in the product. Moreover, the ITO film formed at a low temperature is liable to be scuffed, and when the ITO film is used in contact with other members as in the transparent touch panel, mechanical strength such as scuff resistance is required to be improved. Furthermore, such an ITO film is chemically unstable, and when the ITO film is coated with another organic substance as in an electroluminescence light-emitting element, the quality of the ITO film itself changes with time. Thus, it is necessary to obtain the chemically stable ITO film.

As means for solving the above-mentioned problem, there usually are a method which comprises heating a substrate at the time of the formation of the ITO film to obtain the crystalline ITO film, and another method which comprises subjecting the ITO film formed at room temperature to a heat treatment to obtain the crystalline ITO film [e.g., Japanese Patent Publication 15536/1991 (JP, B2, 3-15536), and Japanese Patent Application Laid-open Nos. 100260/1989 (JP, A, 1-100260), 194943/1990 (JP, A, 2-194943) and 276630/1990 (JP, A, 2-276630)]. Both of these methods take the means for obtaining the crystallized ITO film by the heat treatment. In the methods, it is utilized that the crystallization of the ITO film permits the formation of the film stable to heat and moisture and hence the improvement of the moist heat resistance and the scuff resistance.

A temperature at which the ITO film is crystallized depends upon the method and the conditions of the film formation, but it is usually 180° C. or more.

The crystalline ITO film formed by the heating film formation or the heat treatment after the film formation usually comprises crystallites (or grains) having a diameter of from several $\mu$m to several tens $\mu$m. If the size of the crystallites is small, a large number of boundaries between the crystallites are in the film, and therefore a gas in the atmosphere easily permeates through the boundaries, so that the moist heat resistance deteriorates. In order to prevent this permeation, the size of the crystallites is required to be enlarged, and for this enlargement, it is necessary to increase the temperature of the film formation or the temperature of the heat treatment after the film formation. For sake of the improvement of moist heat resistance, it is effective that the film formation or the heat treatment after the film formation is carried out at a temperature of about 400° C.

One of the products which requires transparent electrodes is an electroluminescence light-emitting element. The known electroluminescence light-emitting element can be manufactured by forming a light-emitting layer and a back surface electrode in turn on a transparent conductive laminate in which the transparent conductive layer is formed on the transparent substrate. For the purpose of effectively applying an electric field to the light-emitting layer to improve a light-emitting luminance, a dielectric layer having a high dielectric constant is usually inserted between the light-emitting layer and the back surface electrode. Further, in order to prevent the light-emitting layer from deteriorating due to water vapor contained in the atmosphere, all or a part of the light-emitting surface of the electroluminescence light-emitting element is usually covered with a moisture barrier film. In this case, usually, the transparent conductive layer is made of the ITO film or the like, and the light-emitting layer is made of zinc sulfide, cadmium sulfide or zinc selenide, and the back surface electrode is made of aluminum or carbon.

Since the electroluminescence light-emitting element can be obtained in the form of a thin sheet, there is expected its application to a use in which such a shape is required, for example, a back light of a liquid crystal display or an emitting element of the dial of a watch.

The electroluminescence light-emitting element is characterized by being obtained in the form of the thin sheet, but its light-emitting durability is poorer as compared with a fluorescent tube which is a conventional light source. For this reason, the electroluminescence light-emitting element has not actually been prevailed so far. Thus, it has been desired to develop the electroluminescence light-emitting element by which the above-mentioned problem can be solved. In particular, the electroluminescence light-emitting element in which a polymeric film is used as the transparent substrate can be applied in a wide utilization range, because it can emit the light while curved.

As one factor by which the luminance of the electroluminescence light-emitting element deteriorates during the continuous light emission, there is the deterioration of the ITO film of the transparent conductive layer used as the transparent electrode as described above. The transparent conductive layer for the transparent electrode of the electroluminescence light-emitting element is required to have a visible light transmittance of 80% or more and a surface resistance of 1000 Ω/□ or less. In addition, since the transparent electrode is used in contact with the light-emitting layer, it must be stable to a material for the light-emitting layer.

As described hereinbefore, the characteristics of the transparent conductive laminate having the formed crystalline ITO film depend upon the size of the crystallites of the ITO film, and therefore the transparent conductive laminate having the excellent moist heat resistance and scuff resistance cannot always be obtained. In order to form the transparent conductive laminate which is excellent in the moist heat resistance and the scuff resistance, the temperature of the film formation or the temperature of the heat treatment after the film formation is strictly controlled to regulate the size of the crystallite. If the temperature of the film formation or the temperature of the heat treatment is 400° C. or more, the transparent conductive laminate having the excellent moist heat resistance and scuff resistance can relatively easily be obtained, but when the transparent conductive laminate is formed by the use of a transparent molded article of a polymer having flexibility, the molded article of the polymer cannot be heated up to 400° C., because a heat-resistant temperature of the molded article of the polymer is usually in the range of about 120 to 250° C.

In the case that a glass substrate is used as the transparent substrate, a crystalline ITO film having a low electric resistance value can be formed as the transparent conductive layer by either of a manner of forming the ITO film at a film formation temperature of 400° C. or more and a manner of forming the film at a low temperature and then carrying out the heat treatment at 400° C. or more. In the case that the molded article of the polymer is used as the transparent substrate, however, the upper limit of the temperature of the film formation or the temperature of the heat treatment after the film formation is limited to the heat-resistant temperature of the molded article of the polymer. The upper limit temperature is usually 250° C. or less. The ITO film formed at a low temperature, particularly at room temperature has many structural faults and is chemically unstable.

In the electroluminescence light-emitting element in which the ITO film formed at the low temperature is used as the transparent electrode, a reaction of the material of the light-emitting layer with the ITO film in the vicinity of the interface between the light-emitting layer and the ITO film is accelerated during the light emission by an applied electric field, so that the quality of the ITO film changes and the light-emitting luminance deteriorates, with the result that a practically sufficient durability cannot be obtained. In order to solve this problem, the ITO film in which the film quality does not change by the contact with the light-emitting layer and the electric field applied for the light emission and which is excellent in the chemical stability needs to be used as the transparent conductive layer.

In practice, in the electroluminescence light-emitting element, it is required that when the light emission is continued under conditions of 40° C. and a relative humidity of 90%, a light emission durability time of a light-emitting luminance/initial light-emitting luminance change ratio $I/I_0$= 0.5 is 200 hours or more. Needless to say, the higher the light-emitting luminance is, the more desirable it is.

SUMMARY OF THE INVENTION

In view of the above-mentioned circumstances, the present invention has been intended, and an object of the present invention is to provide a transparent conductive laminate in which an amorphous ITO film having improved moist heat resistance and scuff resistance is formed on a main surface of a transparent substrate. A conventional amorphous ITO film is unstable to environment, and when the amorphous ITO film is merely exposed to the atmosphere, the electric resistance of the conventional amorphous ITO film rises due to water vapor in the atmosphere. In addition, the mechanical strength of the amorphous ITO film is so weak that it is scuffed by slight friction. Hence, the conventional amorphous ITO film is inferior to a crystalline ITO film in moist heat resistance and scuff resistance. On the contrary, according to the present invention, a good amorphous ITO film having an excellent stability and mechanical strength can be obtained, and by the use of this amorphous ITO film, a transparent conductive laminate which is excellent in the moist heat resistance and the scuff resistance can be supplied. When this laminate is used as the transparent electrode of an electroluminescence light-emitting element, a particularly remarkable effect can be exerted, and since the chemical instability of the ITO film which causes the deterioration of luminance during continuous light emission can be eliminated, the electroluminescence light-emitting element in which the durability of the continuous light emission is improved can be provided.

The present inventors have intensively researched to solve the above-mentioned problem, and as a result, it has been found that, in a transparent conductive laminate in which an amorphous transparent conductive layer mainly comprising indium, tin and oxygen is formed on a transparent substrate, the transparent conductive layer which holds an amorphous state even after subjected to the heat treatment is chemically and physically stable and excellent in the moist heat resistance and the scuff resistance. This transparent conductive layer can be prepared by depositing an amorphous material mainly comprising the oxides of indium and tin and having a resistivity of $1\times10^{-2}$ Ω·cm or more by a sputtering process, and then subjecting the material to a heat treatment to form the amorphous transparent conductive layer having a resistivity of $1\times10^{-2}$ Ω·cm or less. Thus, the present inventors have found that the transparent conductive laminate having a sufficiently low electric resistance value can be obtained by this treatment, and on the basis of this finding, the present invention has been completed. The electron mobility of this transparent conductive laminate is 20 $cm^2/(V\cdot sec)$ or more, and even when the transparent conductive laminate is subjected to the heat treatment, its value is maintained at 20 $cm^2/(V\cdot sec)$ or more and an electron concentration increases. Furthermore, when this transparent conductive laminate is used as the transparent electrode of the electroluminescence light-emitting element, the deterioration of the light-emitting luminance by the continuous light emission can be inhibited to such a remarkable degree as not to be seen in a conventional case.

The method for forming the ITO film having the high resistivity by the sputtering process under a high oxygen concentration atmosphere has been disclosed in Japanese Patent Application Laid-open No. 36703/1991 (JP, A, 3-36703), and there is herein described an ITO film having a surface resistance value in the range of 1 MΩ/□ to several GΩ/□ which can be manufactured by sputtering or vapor deposition in the atmosphere of a heightened oxygen partial pressure. However, the ITO film having such a high electric resistance value, needless to say, cannot directly be used as the transparent electrode of the electroluminescence light-emitting element.

Furthermore, in Japanese Patent Application Laid-open No. 145325/1989 (JP, A, 1-143525), there has been disclosed a method for preparing a transparent conductive film having improved mechanical durability by forming the ITO film under a high oxygen concentration atmosphere by the sputtering process, and then subjecting the film to the heat treatment. In this publication, the amount of an oxygen gas to be introduced is regulated so that a surface resistance change ratio $R/R_0$ ($R_0$=a surface resistance before the heating, and R=a surface resistance after the heating) of the transparent conductive film subjected to the heating at a temperature of 150° C. for 30 minutes after the film formation may be $0.8 \leqq R/R_0 \leqq 1.0$, preferably may be substantially 1, whereby the transparent conductive film having a high keystroke resistance can be obtained. However, in order to obtain the transparent conductive film having the sufficient light-emitting durability as the transparent electrode of the electroluminescence light-emitting element, this preparation method is insufficient as described in the undermentioned comparative example. In the present invention, the ITO film of $1\times10^{-2}$ Ω·cm or more is first formed by the sputtering process under the high oxygen concentration atmosphere, but in the case of a film thickness of 100 nm, this value corresponds to 1000 Ω/□ or more. That is to say, in the present invention, if the resistivity can be lowered by the heat treatment, it is preferred that the ITO film having the highest possible resistivity is first formed. By the utilization of the ITO film whose resistivity before the heat treatment is $1\times10^{-2}$ Ω·cm or less, i.e., 1000 Ω/□ or less in the case of a film thickness of 100 nm, a sufficient effect cannot be obtained, when the ITO film is used as the transparent electrode of the electroluminescence light-emitting element.

One aspect of the present invention is directed to a transparent conductive laminate in which an amorphous transparent conductive layer (B) mainly comprising indium, tin and oxygen is formed on one main surface of a transparent substrate (A), said transparent conductive layer maintaining an amorphous state after subjected to a heat treatment.

Another aspect of the present invention is directed to a transparent conductive laminate in which an amorphous transparent conductive layer (B) mainly comprising indium, tin and oxygen and having a resistivity of $1\times10^{-2}$ Ω·cm or more is formed on one main surface of a transparent substrate (A), the resistivity of said transparent conductive laminate becoming $1\times10^{-2}$ Ω·cm or less by a heat treatment while the amorphous state of said transparent conductive layer is maintained, and another transparent conductive laminate whose resistivity is decreased to $1\times10^{-2}$ Ω·cm or less by a heat treatment.

Still another aspect of the present invention is directed to a transparent conductive laminate in which an amorphous transparent conductive layer (B) mainly comprising indium, tin and oxygen and having an electron mobility of 20 $cm^2/(V\cdot sec)$ or more is formed on one main surface of a transparent substrate (A), said transparent conductive layer maintaining an electron mobility of 20 $cm^2/(V\cdot sec)$ or more and an amorphous state by a heat treatment, a transparent conductive laminate in which the electron density of the transparent conductive layer (B) is increased by the heat treatment, and a transparent conductive laminate in which the electron density is increased, while an electron mobility of 20 $cm^2/(V\cdot sec)$ or more and the amorphous state are maintained.

The transparent conductive layer (B) is preferably formed by a sputtering process under a high oxygen concentration atmosphere, and the transparent substrate (A) is preferably a molded article of a transparent polymer.

The heat treatment is preferably carried out in the range of 80 to 180° C. in the air, in an atmosphere of an inert gas such as nitrogen or in vacuo. Moreover, between the transparent substrate (A) and the transparent conductive layer (B), a metal thin layer may be formed.

Furthermore, the present invention is directed to an electroluminescence light-emitting element in which a light-emitting layer (C) containing at least zinc sulfide and a back surface electrode (D) are formed in turn on the conductive surface of a transparent conductive laminate, the above-mentioned transparent conductive laminate being used in said electroluminescence light-emitting element. This element can exert a noticeable effect, when driven by a power source superposing a DC component to an AC component.

DESCRIPTION OF THE PREFERRED EMBODIMENTS

Figure 1:
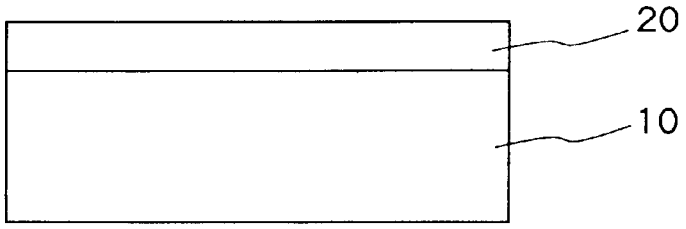
FIG. 1 is a sectional view of a transparent conductive laminate according to a preferable embodiment of the present invention.

A transparent conductive laminate according to a preferable embodiment of the present invention, as shown in FIG. 1, comprises a transparent substrate 10 and at least a transparent conductive layer 20 formed on the transparent substrate 10. This transparent conductive layer 20 is an amorphous film mainly comprising indium, tin and oxygen, i.e., an amorphous ITO film.

Figure 2:
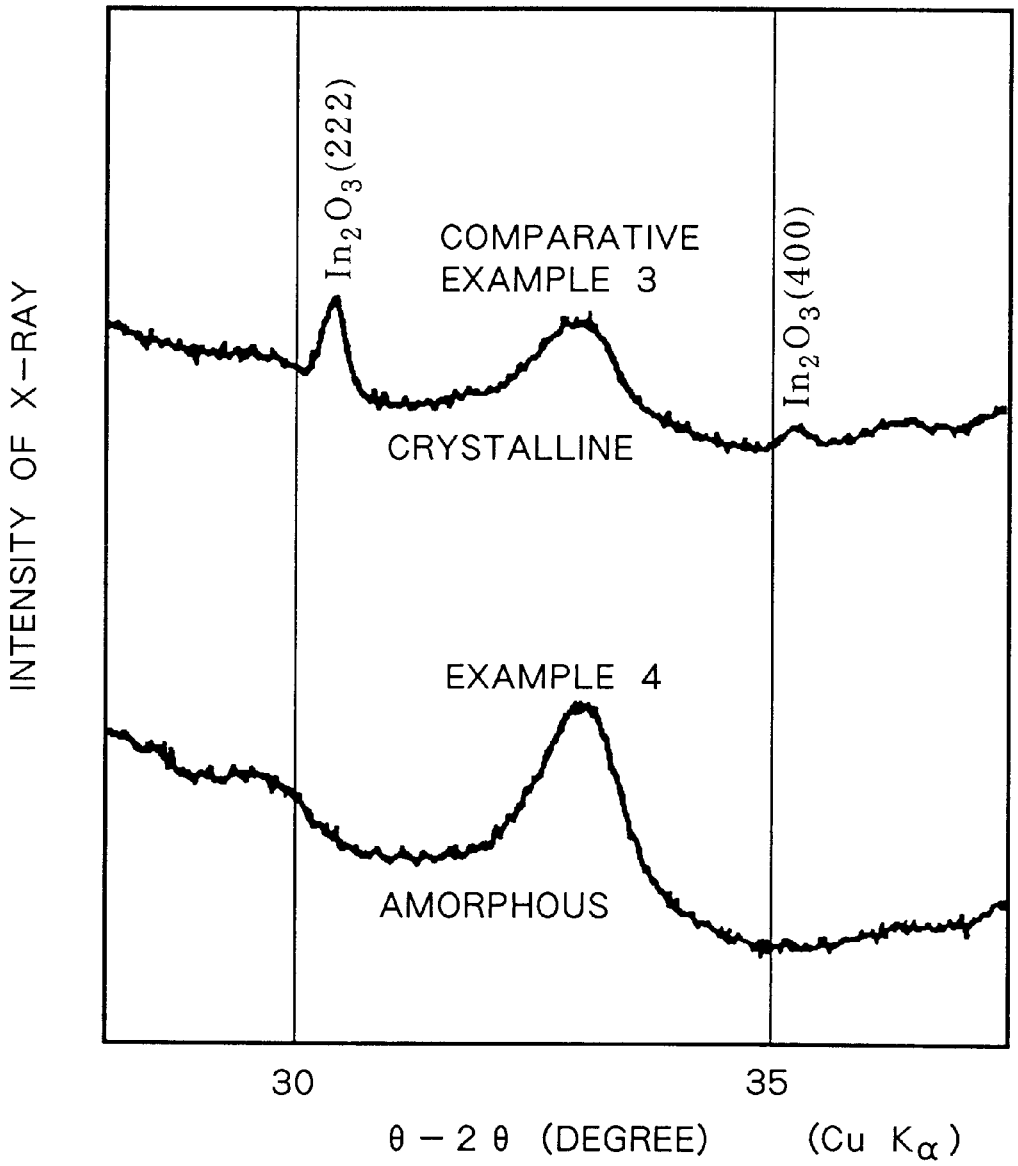
FIG. 2 is a graph showing X-ray diffraction patterns of a transparent conductive laminate (Example 4) in which a transparent conductive layer is amorphous even after a heat treatment, and another transparent conductive laminate (Comparative Example 3) in which the transparent conductive layer is crystalline after the heat treatment.

In the present invention, the amorphous ITO film does not show an $In_2O_3$(222) peak and an $In_2O_3$(400) peak for certifying a crystalline phase in X-ray diffraction patterns by a θ–2θ method. In the case that a $CuK_\alpha$ ray is used as an X-ray, the $In_2O_3$(222) peak appears at 2θ=30°–31°, and the $In_2O_3$(400) peak appears at 2θ=35°–36°. FIG. 2 shows examples of X-ray diffraction patterns ($CuK_\alpha$ ray) of an amorphous ITO film (Example 4) and a crystalline ITO film (Comparative Example 3).

The ITO film can usually be formed by a reactive sputtering process in which argon is used as a sputtering gas and oxygen is used as a reactive gas. As a sputter target, an indium-tin alloy or an indium oxide-tin oxide sinter is used. In the case that either target is used, there is a sputtering gas of an argon oxygen partial pressure ratio which can minimize an electric resistivity of the formed ITO film. Conventionally, in forming the ITO film, the argon-oxygen partial pressure ratio of the sputtering gas is controlled so that a resistivity may be minimum, whereby the ITO film having a low resistivity can be obtained.

However, the conventional ITO film which has been formed at 180° C. or less, particularly at room temperature in the sputter gas of the argon oxygen partial pressure ratio for minimizing the electric resistivity and which has not been subjected to any post treatment is an amorphous film which contains many structural faults such as oxygen defects and which are chemically and physically unstable and brittle. Thus, in the electroluminescence light-emitting element having an excellent light-emitting durability, the stable amorphous ITO film having the few structural faults is required to be used as a transparent electrode. In order to obtain such a stable amorphous ITO film, it is necessary to form the ITO film having a resistivity of $1\times10^{-2}$ Ω·cm or more by the use of the sputtering gas for the sputtering process in which an oxygen content is larger than the argon-oxygen partial pressure ratio for minimizing the resistivity. In other words, by the use of the sputtering gas in which an oxygen partial pressure is larger than the value for minimizing the resistivity, the stable ITO film having the amorphous structure can be obtained in which structural faults such as the oxygen defects are small.

As carrier electrons for undertaking the electric conduction of the ITO film, there are those which can be produced by oxygen defects and those which can be produced by tin. In the ITO film having the few oxygen defects formed under conditions where the oxygen partial pressure is high, an electron mobility for representing the mobility of the carrier electrons is 20 $cm^2/(V\cdot sec)$ or more. That the electron mobility is high means that defects for disturbing the movement of the carrier electrons in the film are small. In the present invention, the electron mobility is preferably 20 $cm^2/(V\cdot sec)$ or more in order that the ITO film after the heat treatment may maintain the amorphous state.

However, when the oxygen partial pressure is larger than the value for minimizing the resistivity, an electron density lowers, so that the resistivity of the ITO film is as high as $1\times10^{-2}$ Ω·cm or more. A resistivity ρ [Ω·cm] of the ITO film can be obtained in accordance with the equation (1), $$\rho=1/(e\cdot n\cdot\mu) \quad (1).$$

wherein n is an electron density [electrons/$cm^3$], $\mu$ is an electron mobility [$cm^2/(V\cdot sec)$], and e is an unit electron charge [C]. Incidentally, an electric resistance value can be obtained by dividing the resistivity of the ITO film by the thickness of the ITO film.

The transparent electrode of the electroluminescence light-emitting element is required to have a low electric resistance, and so the transparent conductive laminate in which the ITO film having the low electron density is formed on the main surface of the substrate cannot be directly used in the electroluminescence light-emitting element. Thus, in the present invention, the ITO film is subjected to the heat treatment to lower the resistivity to $1\times10^{-2}$ Ω·cm or less. However, even when the resistivity is lowered, the effect of the heat treatment cannot be exerted, if the electron mobility of the ITO film is not maintained at 20 $cm^2/(V\cdot sec)$ or more or if the amorphous structure is not maintained. That is to say, the drop of the electron mobility means that the structure of the ITO film has changed, and such an ITO film is so unstable that its structure is changed by the heat treatment and it is poor in the moist heat resistance and the scuff resistance. Therefore, the transparent conductive laminate comprising such an ITO film is not practical.

The drop of the resistivity of the ITO film by the heat treatment is caused by the increase of the electron density, and it is desired that at least the electron mobility does not drop. That is to say, in the present invention, it is preferred to previously form such a stable amorphous ITO film that the electron mobility does not drop even by the application of the heat treatment and the amorphous structure is maintained, and it is also preferred that the thus formed ITO film is further subjected to the heat treatment. The reason why the electron density increases by the heat treatment is not definite, but it can be presumed that excessive oxygen is released from the film to generate the oxygen defects in the film and to thereby produce the carrier electrons, and that tin atoms move to positions where the carrier electrons are efficiently produced. Incidentally, the heat treatment may be carried out at a time when an electrode of a display element such as a liquid crystal display or the electroluminescence light-emitting element is formed.

In the case that the electroluminescence light-emitting element in which the molded article of a polymer is used as the transparent substrate is curved and used, curve durability can be improved by enhancing the adhesive properties between the molded article of the polymer and the transparent conductive layer. The enhancement of the adhesive properties can be achieved by inserting such a metallic thin film as not to impair the transparency between the molded article of the polymer and the transparent conductive layer.

As a driving power source for emitting the light from the electroluminescence light-emitting element, an AC power source is usually used, but it may be an AC power source containing no DC component or an AC power source containing the DC component. If the power source containing no DC component for output is used as the power source for forming an AC waveform from a DC power source such as a cell, a circuit is complex, which is not suitable for miniaturization. From this viewpoint, it is desirable to use the power source for outputting the AC containing the DC component. However, if the power source contains the DC component, the deterioration of the ITO film which is the transparent electrode is liable to be accelerated, and so the more stable ITO film has been required.

The substrate which can be used in the present invention is required to be transparent to visible light, and examples of the usable substrate include molded articles of inorganic compounds such as glass and quartz as well as molded articles of organic polymers. Above all, the molded articles of the organic polymers are more suitable because of being lightweight and unbreakable. Typical examples of materials for the usable transparent molded articles of the polymers include polyethylene terephthalate, polyether sulfones, polystyrenes, polyethylene, polyethylene naphthalate, polyarylates, polyetheretherketones, polycarbonates, polypropylene, polyimides and triacetyl celluloses. The transparent molded article of the polymer may be plate-like or film-like, so long as the main surface of the formed transparent conductive layer is smooth. In the case that the plate-like molded article of the polymer is used as the substrate, the transparent conductive laminate having excellent dimensional stability and mechanical strength can be obtained, because this kind of molded article is excellent in the dimensional stability and the mechanical strength. Therefore, the plate-like molded article of the polymer can suitably be used for applications in which the dimensional stability and the mechanical strength are required. Furthermore, the transparent polymeric film has flexibility, and in the case that this film is used as the substrate, the flexible electroluminescence light-emitting element can be obtained, and therefore this element is particularly effective in the case that it is curved when used. Moreover, the polymeric film is thinner than the plate-like molded article, so that the thin type electroluminescence light-emitting element can be obtained. Since the transparent conductive layer, the light-emitting layer and the back surface electrode can continuously be formed from the flexible polymeric film by a roll-to-roll method, the transparent conductive laminate can be efficiently produced by the use of this flexible polymeric film. In this case, the thickness of the film is usually in the range of 10 to 250 μm. If the thickness of the film is less than 10 μm, the mechanical strength which the substrate should have is insufficient, and if it is more than 250 μm, the flexibility is poor, so that such a thick film is not suitable for a case that the film is wound around a roll and then utilized.

Of the materials for transparent molded articles, the polyethylene terephthalate can be more suitably utilized, because of being excellent in transparency and workability. Furthermore, the polyether sulfones are excellent in the heat resistance, and hence they can be more suitably utilized in the case that the heat treatment is required in assembling the electroluminescence light-emitting element.

The surface of the substrate may be subjected to a sputtering treatment, a corona discharge treatment, a flame treatment, ultraviolet irradiation, an etching treatment such as electron beam irradiation, or an undercoating treatment for the purpose of improving the adhesive properties of the amorphous transparent conductive layer mainly comprising the oxides of indium and tin to the substrate. Furthermore, prior to the formation of the amorphous transparent conductive film mainly comprising the oxides of indium and tin, a dust-proof treatment such as solvent cleaning or ultrasonic cleaning may be carried out for the substrate, if necessary.

In the present invention, the amorphous transparent conductive film (the ITO film) mainly comprising the oxides of indium and tin is formed on one main surface of the substrate. The composition of this transparent conductive film has an influence on electrical properties and transparency, but in general, a tin content to indium is in the range of about 3 to 50% by weight, and the number of oxygen atoms per atom of indium is in the range of about 1.3 to 1.8. The oxygen content and the tin content have an influence on the electron mobility and the electron density of the transparent conductive film, and therefore the control of their contents is required to be carried out at the time of the film formation.

In the present invention, as already described, the transparent conductive film mainly comprising the oxides of indium and tin formed on the substrate is amorphous and can maintain the amorphous state even after being subjected to the heat treatment. Its ITO film is amorphous and has a resistivity of $1\times10^{-2}$ Ω·cm or more at the time of the film formation, and even after the heat treatment, the ITO film must maintain the amorphous state and have a resistivity of $1\times10^{-2}$ Ω·cm or less so that it may be used as the transparent electrode. In order to meet these requirements, the ITO film is formed under a high oxygen concentration atmosphere by the sputtering process.

The high oxygen concentration atmosphere referred to in the present invention means an atmosphere in which an oxygen partial pressure ratio is higher than an argon-oxygen partial pressure ratio for minimizing the resistivity. In this case, the preferable oxygen partial pressure depends upon the density of the target, a composition ratio of the indium oxide and the tin oxide, a film formation rate and the like, but it can be experimentally determined so that the resistivity may be $1\times10^{-2}$ Ω·cm or more. In general, the oxygen partial pressure to the total pressure is in the range of about 3 to 40% in the case that the oxides of indium and tin are used as the targets, and in the range of about 40 to 80% in the case that an indium-tin alloy is used as the target. When the ITO film is deposited under the high oxygen concentration atmosphere, the ITO film having a stable amorphous structure in which a few structural faults such as oxygen defects are present can be obtained.

The high oxygen concentration atmosphere will further be described in detail. When the ITO film is formed by the sputtering process, it is necessary that an oxygen concentration should be set to be higher than the partial pressure ratio for minimizing the resistivity so that the resistivity of the amorphous film which has not been subjected to the heat treatment immediately after the film formation may be in excess of $1\times10^{-2}$ Ω·cm. Even when the sputtering is carried out in the atmosphere in which the oxygen concentration is higher than the partial pressure ratio for minimizing the resistivity, the formed ITO film is liable to crystallize and unstable, if the resistivity of the formed ITO film is $1\times10^{-2}$ Ω·cm or less. Furthermore, in the case that the oxygen concentration is lower than the partial pressure ratio for minimizing the resistivity, the ITO film is liable to crystallize and to become, even if the resistivity of the formed ITO film is in excess of $1\times10^{-2}$ Ω·cm.

Moreover, as a sputter gas for the sputtering, argon is usually used, but other inert gases such as neon, xenon and krypton are also usable.

The electron mobility of the thus formed ITO film is 20 $cm^2/(V\cdot sec)$ or more, and it can maintain an electron mobility of 20 $cm^2/(V\cdot sec)$ or more even after the heat treatment.

The content of tin with respect to indium is preferably in the range of 3 to 50% by weight. The blend of tin enables the production of carrier electrons in the ITO film and the drop of the resistivity. If the content of tin is too low, the resistivity rises, and tin as an impurity for indium is not present, so that the crystals of indium oxide are liable to be formed at the time of the heat treatment. Accordingly, in order to surely maintain the amorphous state even when the heat treatment is done, the content of tin with respect to indium is preferably in the range of 10 to 50% by weight, more preferably 15 to 50% by weight. Conversely, if the content of tin is too high, the resistivity rises, so that the resistivity does not drop unpreferably, even when the heat treatment is done.

The transparent electrode of the electroluminescence light-emitting element is required to possess a low electric resistance, and therefore there cannot be used the transparent conductive laminate in which the ITO film having a high resistivity as much as $1\times10^{-2}$ Ω·cm or more is formed on one main surface of the substrate. Thus, in the case that the transparent conductive laminate having the low electric resistance is required, the heat treatment is done to increase the electron density and to lower the resistivity to $1\times10^{-2}$ Ω·cm or less. In this case, it is important that the ITO film which cannot maintain the amorphous structure after the heat treatment is so unstable that the structure of the ITO film is changed by the heat treatment, and in the case that the ITO film is used the electrode, the light-emitting durability of the electroluminescence light-emitting element cannot be improved. The transparent conductive laminate comprising the ITO film which cannot maintain the amorphous state is not practical and cannot maintain an electron mobility of 20 $cm^2/(V\cdot sec)$ or more.

However, the ITO film formed so as to obtain a resistivity of $1\times10^{-2}$ Ω·cm or more by the sputtering process under the high oxygen concentration atmosphere in which an oxygen partial pressure ratio is higher than the partial pressure ratio of argon-oxygen of the sputter gas for minimizing the resistivity is the stable amorphous film which is not crystallized by the heat treatment. Here, if the oxygen concentration at the time of the film formation is too high, a very long time is taken to lower the resistivity, or this resistivity does not lower to $1\times10^{-2}$ Ω·cm or less. Accordingly, the oxygen concentration for the formation of the ITO film whose resistivity sufficiently lowers by the heat treatment is required to be experimentally determined, but when the resistivity is 100 Ω·cm or more, it scarcely lowers to $1\times10^{-2}$ Ω·cm or less even when the heat treatment is carried out.

The conditions of the heat treatment is such that the ITO film can maintain the amorphous state even after the heat treatment, and the object of the heat treatment can be achieved by subjecting the ITO film to a temperature more than room temperature for a long period of time, but a preferable heating temperature is in the range of 80 to 180° C. If the heating temperature is less than 80° C., the effect of increasing the electron density is small, so that a long treatment time of several days is required. Conversely, if the heating temperature is more than 180° C., the unpreferable ITO film is formed which is a crystalline film of small crystallites having many structural faults such as crystalline boundaries. A temperature of 80 to 180° C. can be applied to glass and most of the molded article of the polymer, and so this temperature is particularly suitable for the substrate comprising the molded article of the polymer to which the heat treatment at a high temperature cannot be applied.

With regard to an environmental atmosphere at the time of the heating, any atmosphere except for a strong oxidizing atmosphere is acceptable, and so the heating can be carried out under an atmosphere of vacuum, the air or an inert gas such as nitrogen. A heating time depends upon the kind of substrate, the resistivity and the thickness of the ITO film, the treatment temperature and the like, and it can be experimentally determined, but it is usually in the range of about 10 minutes to 24 hours. The saturation of the electron density is attained by the heating for a certain heating time, and hence it is meaningless to carry out the heat treatment for an excessively long time.

Figure 3:
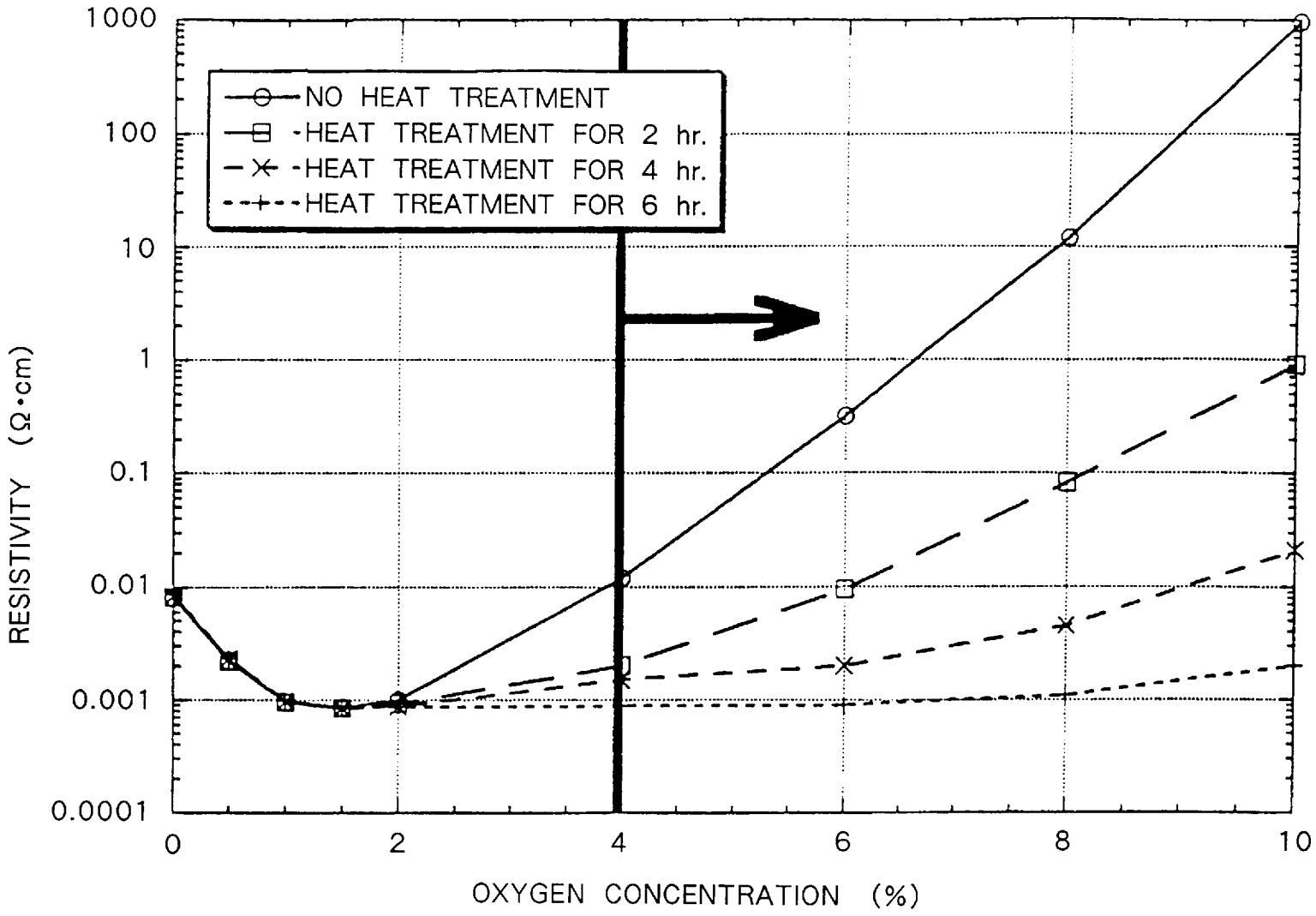
FIG. 3 is a graph showing relations between the oxygen concentration at the time of film formation and the resistivity of a formed ITO film on the basis of different heat treatment times.

One example of the conditions of the film formation and the conditions of the heat treatment will be described with reference to FIG. 3 of the attached drawings. FIG. 3 is a graph showing relations between an oxygen partial pressure at the time of film formation and the resistivity of the ITO film. The formation of the ITO film is as follows.

The ITO film was formed on one main surface of a polyethylene terephthalate film (thickness=188 $\mu$m) by the use of indium oxide-tin oxide (composition ratio $In_2O_3$:$SnO_2$=80:20 wt %) as a target and an argon-oxygen mixed gas (total pressure=266 mPa) as a sputter gas in accordance with a magnetron DC sputtering process. A heat treatment temperature was 150° C., and heating treatment times were 0 minute, 2 hours, 4 hours and 6 hours.

When the total pressure of the argon-oxygen mixed gas is 266 mPa, the resistivity is minimum under an oxygen partial pressure of 4 mPa (1.5%) at a certain film formation rate, and this condition is the conventional condition of the ITO film formation. The high oxygen concentration referred to in the present invention is an oxygen concentration at which the resistivity is $1\times10^{-2}$ Ω·cm in FIG. 3, i.e., about 10 mPa (4.0%) or more. As is apparent from the results in FIG. 3, the resistivity drops by the heat treatment. The higher the oxygen concentration is, the larger the resistivity of the obtained ITO film, and the longer the time which is required to lower the resistivity.

As the formation method of the stable amorphous transparent conductive film (the ITO film) mainly comprising the oxides of indium and tin, there can be employed any conventional known physical vapor deposition method such as a vacuum deposition method, a sputtering process or an ion plating method. Above all, the sputtering process can suitably be used, because an oxygen content in the film can easily be controlled.

In the sputtering process, an indium-tin alloy or an indium-tin oxide is used as a target, and an inert gas such as argon is used as a sputter gas. In addition, oxygen is used as a reactive gas. Under the conditions of a pressure of 13.3 to 2660 mPa and a substrate temperature in the formed film of 20 to 150° C., a DC or a radio frequency (RF) magnetron sputtering process can be utilized.

The thickness of the ITO film is controlled to give a desired value of the surface resistance thereof, and the surface resistance can be decreased by increasing the thickness of the ITO film. However, an unnecessarily thick ITO film is liable to cause a trouble such as a decrease in a light transmittance and a crack in the ITO film by bending. If the ITO film is too thin, the surface resistance of the ITO film exceeds the desired value. Since the long time is necessary for forming a thick ITO film, it is not preferable to unnecessarily thicken the ITO film. The thickness of the ITO film is preferably in range of 30 to 300 nm, and more preferably in range of 50 to 200 nm.

In the present invention, a thickness of a film is controlled by a following manner. First, a desired thin film as a reference is formed on a sufficiently flat substrate such as a glass plate and a step between a portion at which the film is formed and another portion at which the film is not formed is measured by a surface. roughness meter to determine the thickness of the reference film. Next, deposition rate R [nm/sec] is calculated by dividing the thickness of the reference by the deposition time thereof. Then, the thickness of the film is controlled by a deposition time t [sec] using the deposition rate R as a constant. The thickness of the film is represented by following equation (2), $$\text{Thickness of film [nm]}=R/t \qquad (2).$$

An atomic composition of the transparent conductive layer formed by the above-mentioned method can be measured by an Auger electron spectroscopy method (AES), an inductive coupling plasma (ICP) emission spectroscopy method, a Rutherford back scattering method (RBS) or the like. Furthermore, the thickness of the transparent conductive layer can be measured by a depth profile observation by the Auger electronic spectroscopy, a section observation by a transmission electron microscope, or the like. Moreover, the crystallinity of the ITO film can be judged by an X-ray diffraction method (XRD) or an electron diffraction method.

Figure 4:
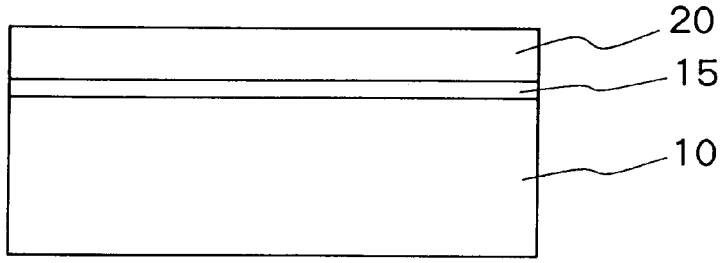
FIG. 4 is a sectional view of the transparent conductive laminate having a metal thin layer.

In order to enhance the adhesive properties between the transparent substrate and the transparent conductive layer, as shown in FIG. 4, a metal thin layer 15 having such a thickness as not to impair the transparency may be inserted between a substrate 10 and a transparent conductive layer 20. Particularly in the case that a polymeric film is used as the transparent substrate to obtain the flexible electroluminescence light-emitting element, the insertion of the metal thin layer is a means effective to improve flexing resistance. This metal thin layer 15 comes in contact with the ITO film, and therefore it can be presumed that most of the layer actually becomes metal oxides, but this phenomenon has no influence on the effect of the present invention. Typical examples of the usable metal material for the metal thin layer include nickel, chromium, gold, silver, zinc, zirconium, titanium, tungsten, tin, palladium and alloys comprising two or more thereof. No particular restriction is put on the thickness of the metal thin layer, any thickness is acceptable, so long as it is such as not to impair the transparency, but it is preferably in the range of about 0.02 to 10 nm. If the metal thin layer is too thin, the sufficient improvement effect of the adhesive properties cannot be obtained, and conversely, if it is too thick, the transparency is impaired. It is to be noted that, in the present invention, the thickness of the metal thin layer is also determined by the above equation (2). Therefore, the metal thin layer can be formed thin by shortening the deposition time. In the present invention, it is not necessary to form the metal thin layer in a form of a complete and uniform film. For example, the metal thin layer may be formed in a form of an island on the substrate.

As a method for forming the metal thin layer, there is a conventional known thin layer formation method, and typical examples of the suitable formation method include a sputtering process and a vacuum deposition method. Above all, the sputtering process is preferable, because this process can suitably be utilized for the formation of the transparent conductive layer which is to be laminated on the previously formed metal thin layer, and so these two layers can be formed and laminated by one apparatus using the sputtering process, which can lead to the improvement of a production efficiency.

Furthermore, for the purpose of improving mechanical properties, a transparent hard coating layer may be formed on the surface opposite to the surface of the substrate on which the ITO film is formed, and an optional protective layer may further be formed on the ITO film so as not to impair electric resistance, transparency, environmental resistance, and durability in the case that it is used as the transparent electrode. In addition, in order to improve the transparency and to prevent the release of a gas and the separation of components from the substrate at the time of the heat treatment, a suitable thin layer other than the metal thin layer may be inserted between the substrate and the transparent conductive layer.

Figure 5:
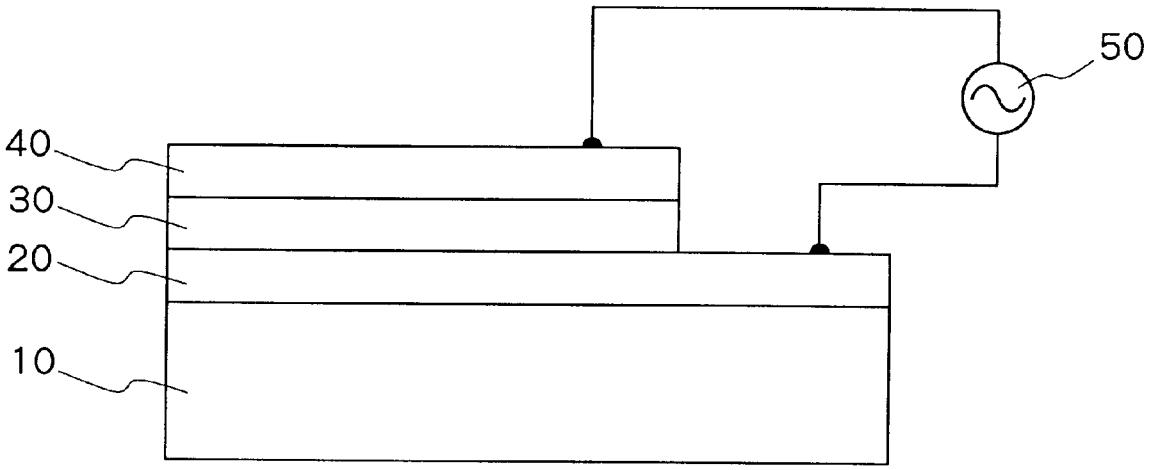
FIG. 5 is a sectional view of an electroluminescence light-emitting element in a preferable embodiment of the present invention.

Next, a preferable embodiment of the electroluminescence light-emitting element of the present invention will be described with reference to FIG. 5.

The transparent conductive layer 20 is formed on one main surface of the transparent substrate 10, and further, on the transparent conductive layer 20, a light-emitting layer 30 containing at least zinc sulfide and a back surface electrode 40 are laminated in turn. The transparent conductive layer 20 can be formed by first forming a stable amorphous film mainly comprising the oxides of indium and tin on one main surface of the substrate 10, and then subjecting the film to the heat treatment to lower the resistivity of this film to $1\times10^{-2}$ Ω·cm or less, keeping up the amorphous state. When an electric field is applied between the transparent conductive layer 20 and the back surface electrode 40 by a power source 50, the light-emitting layer 30 emits the light.

As a material for the light-emitting layer, zinc sulfide containing a suitable activator as a luminescence center is preferably used. An emission color depends upon the selected activator which is mixed with zinc sulfide. For example, when copper is used as the activator, the emission color is green, and when manganese is used, it is yellow. Zinc sulfide is usually in the state of powder, and its particle diameter is usually in the range of about 20 to 30 μm. Needless to say, a material containing, as a main component, a compound other than zinc sulfide can be used as the light-emitting layer, so long as it can emit the light by the electroluminescence.

For the formation of the light-emitting layer, a coating method can be used. That is to say, the light-emitting layer can be formed by first mixing a zinc sulfide powder with a suitable binder, dispersing the mixture in a suitable solvent, coating the transparent conductive layer with the dispersion, and then subjecting it to the heat treatment at 100 to 150 ° C. to vaporize the solvent. Examples of the suitably usable binder include cyanoethyl cellulose, cyanoethyl plurane and cyanoethyl polyvinyl alcohol. The suitably usable solvent is a solvent which can vaporize by the heat treatment of 100 to 150° C., and examples of such a solvent include acetone and propylene carbonate. The thickness of the light-emitting layer is not particularly restricted, and any thickness is acceptable, so long as it permits the acquisition of a sufficient light-emitting luminance, but it is usually 50 μm or more. If the light-emitting layer is too thin, the sufficient light-emitting luminance cannot be obtained. In forming the light-emitting layer, for example, an edge portion or the like of the transparent conductive layer must remain as it is without forming the light-emitting layer thereon so that the electrode can be taken out later on from this portion of the transparent conductive layer.

After the formation of the light-emitting layer, the back surface electrode is further formed thereon, but in general, in order to improve the light-emitting luminance, a dielectric layer is inserted between the light-emitting layer and the back surface electrode. The dielectric layer may be formed from a material having a high dielectric constant by a physical vapor deposition method or a chemical vapor deposition method, but for convenience, the same coating method as in the formation of the light-emitting layer can be used. According to the coating method, a powder having a high dielectric constant such as barium titanate is dispersed in the same binder and solvent as used in the formation of the light-emitting layer, and the coating of the resulting dispersion is then carried out in the same manner as in the formation of the light-emitting layer.

Lastly, the back surface electrode for applying the electric field to the light-emitting layer is formed. Any material for the back surface electrode can be used, so long as it is electrically conductive, and examples of the preferable material for the back surface electrode include metals such as aluminum and silver and carbon.

In order to emit light from the electroluminescence light-emitting element prepared by the above-mentioned means, the electric field is applied between the transparent conductive layer and the back surface electrode. The electric field to be applied is preferably an AC field containing no DC component. If the DC component is superposed on the AC component, the electric field is applied in one direction to the inside of the electroluminescence light-emitting element, so that the deterioration of the transparent conductive layer is accelerated. When the AC on which the DC component is superposed is applied to the conventional ITO film, the deterioration of the ITO film is noticeably accelerated, but as for the ITO film according to the present invention, even when the AC on which the DC component is superposed is applied thereto, the deterioration is controlled, so that the ITO film is kept practical. The voltage and the frequency of an AC power source which can be used herein are such that the light-emitting element can emit the light, and for example, an inverter power source having an output of 100 V (an effective value) and about 400 Hz can be used. Such a power source is disclosed in, for example, Japanese Patent Application Laid-open No. 257591/1990 (JP, A, 2-257591).

EXAMPLES

Next, the present invention will be described in more detail with reference to examples.

For transparent conductive laminates prepared in examples and comparative examples, electron mobility, electron density, resistivity, crystallinity, moist heat resistance and scuff resistance were evaluated before and after a heat treatment by the following procedures.

(1) Resistivity, electron mobility and electron density:

They were measured by a Hall measuring method.

(2) Crystallinity:

X-ray diffraction patterns using a $CuK_\alpha$ ray were taken by a θ–2θ method, and the crystallinity was judged by the presence/absence of an $In_2O_3$(222) peak at 2θ=30°–31° and an $In_2O_3$(400) peak at 2θ=35°–36°.

(3) Moist heat resistance:

An initial surface resistance $R_0$ (Ω/□) was measured by a four-terminal method, and after the transparent conductive laminate was allowed to stand under conditions of 40° C. and a humidity of 90% for 100 hours, a surface resistance $R_1$ (Ω/□) was similarly measured. The moist heat resistance was judged on the basis of a ratio of $R_1/R_0$. That is to say, when $R_1/R_0$ is 1.0, it can be judged that the electric resistant values of the transparent conductive laminate do not change, and so it is excellent in the moist heat resistance.

(4) Scuff resistance:

An initial surface resistance $R_0$ (Ω/□) was measured by a four-terminal method, and after the surface of the transparent conductive laminate was subjected to reciprocative friction 100 times with a gauze of the Japanese Pharmacopoeir under a load of 250 gf/cm$^2$, a surface resistance $R_2$ (Ω/□) was similarly measured. The scuff resistance was judged on the basis of a ratio of $R_2/R_0$. That is to say, when $R_2/R_0$ is 1.0, it can be judged that the electric resistant values of the transparent conductive laminate do not change by the friction of the gauze, and so it is excellent in the scuff resistance.

Example 1

An ITO film having a thickness of 50 nm was formed on one main surface of a polyethylene terephthalate film (thickness=188 μm) in accordance with a magnetron DC sputtering process by the use of an indium oxide-tin oxide sinter (composition ratio $In_2O_3$:$SnO_2$=80:20 wt %) as a target and an argon-oxygen mixed gas (total pressure=266 mPa, oxygen partial pressure=5.3 mPa) as a sputter gas to obtain a transparent conductive layer. Afterward, the thus obtained layer was subjected to a heat treatment at 150° C. for 4 hours in the atmosphere.

Examples 2 and 3

The same procedure as in Example 1 was repeated except that an oxygen partial pressure was 13.3 mPa (Example 2) or 26.6 mPa (Example 3), thereby preparing a transparent conductive laminate.

Comparative Examples 1 and 2

The same procedure as in Example 1 was repeated except that an oxygen partial pressure was 0 mPa, i.e., an argon gas alone (Comparative Example 1) or 2.7 mPa (Comparative Example 2), thereby preparing a transparent conductive laminate.

Figure 6:
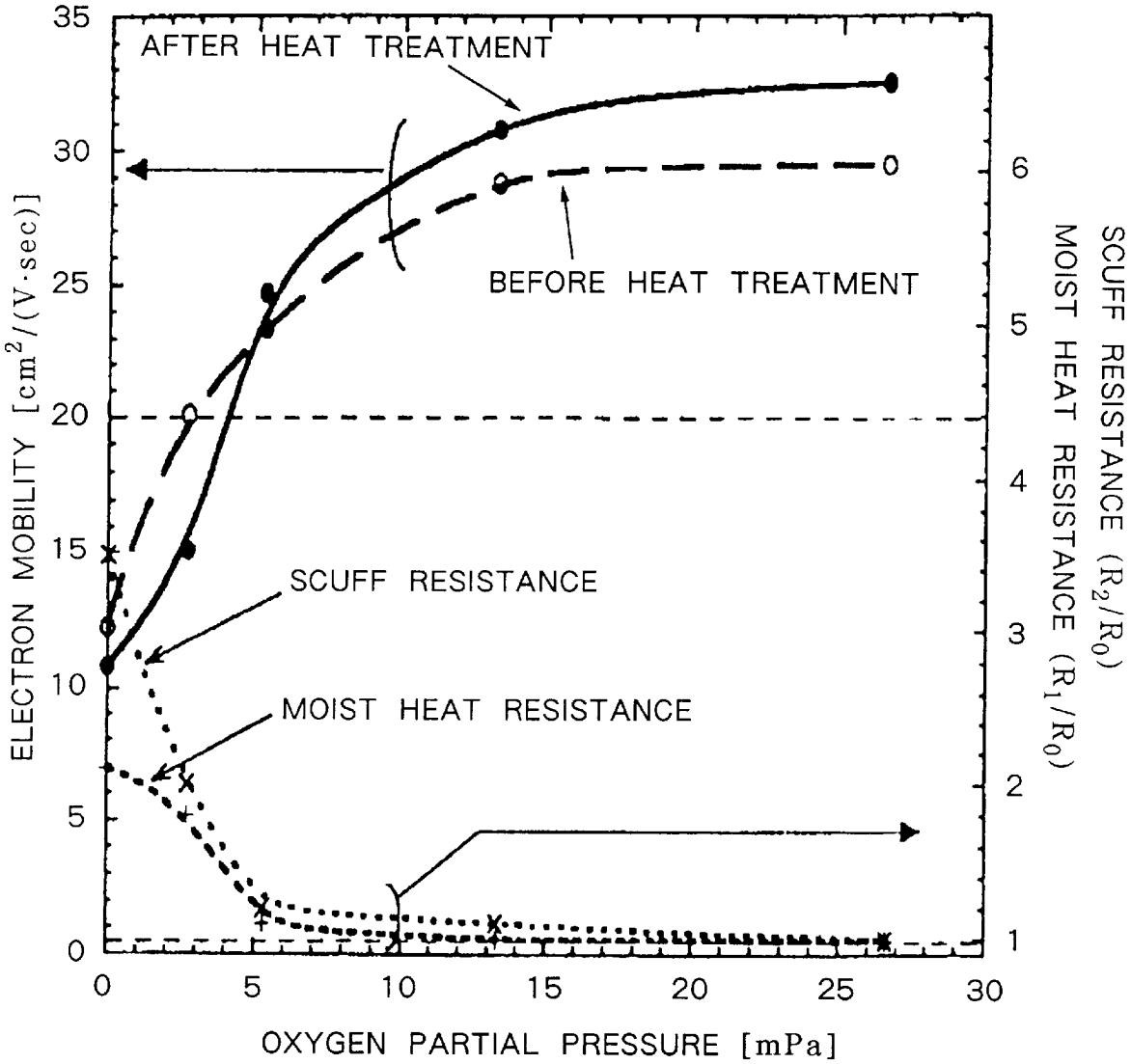
FIG. 6 is a graph showing relations of the electron mobility, the moist heat resistance and the scuff resistance of an ITO film to an oxygen partial pressure at the time of the film formation.

The results of Examples 1 to 3 and Comparative Examples 1 and 2 are shown in Table 1. Furthermore, these results are shown in the form of a graph in FIG. 6.

(thickness=188 μm) in accordance with a DC sputtering process by the use of an indium-tin alloy (composition ratio In:Sn=90:10 wt %) as a target and an argon-oxygen mixed gas (total pressure=266 mPa, oxygen partial pressure=117 mPa) as a sputter gas to obtain a transparent conductive layer. Afterward, the thus obtained layer was subjected to a heat treatment at 150° C. for 4 hours in the atmosphere to prepare a transparent conductive laminate.

Examples 5 and 6

The same procedure as in Example 4 was repeated except that an oxygen partial pressure was 122 mPa (Example 5) or 128 mPa (Example 6), thereby preparing a transparent conductive laminate.

Comparative Examples 3 and 4

The same procedure as in Example 4 was repeated except that an oxygen partial pressure was 106 mPa (Comparative Example 3) or 111 mPa (Comparative Example 4), thereby preparing a transparent conductive laminate.

Figure 7:
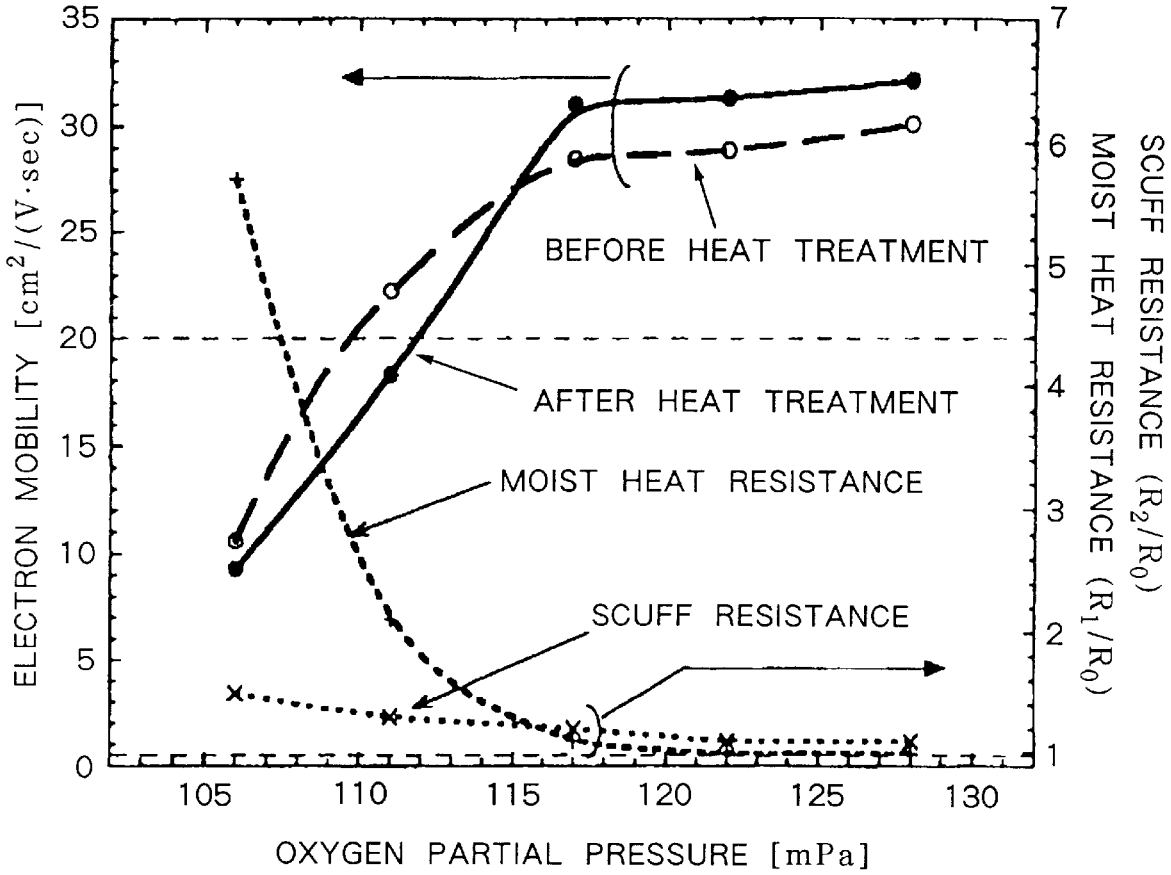
FIG. 7 is a graph showing relations of the electron mobility, the moist heat resistance and the scuff resistance of the ITO film to the oxygen partial pressure at the time of the film formation.

The results of Examples 4 to 6 and Comparative Examples 3 and 4 mentioned above are shown in Table 2. Furthermore, these results in Table 2 are simply shown in the form of a graph in FIG. 7. In addition, as examples of the X-ray diffraction patterns of transparent conductive laminates comprising the crystalline and the amorphous ITO films, the X-ray diffraction patterns of Comparative Example 3 and Example 4 are shown in FIG. 2.

TABLE 1

| | Oxygen Partial Pressure | Electron Mobility (cm$^2$/V · sec) Heat Treatment | | Electron Density × $10^{17}$ (electrons/cm$^3$) Heat Treatment | |
|---|---|---|---|---|---|
| | (mPa) | Before | After | Before | After |
| Comp. Ex. 1 | 0 | 12.2 | 10.8 | 810 | 810 |
| Comp. Ex. 2 | 2.7 | 20.1 | 15.1 | 790 | 740 |
| Example 1 | 5.3 | 23.4 | 24.7 | 260 | 600 |
| Example 2 | 13.3 | 28.8 | 30.8 | 110 | 410 |
| Example 3 | 26.6 | 29.5 | 32.5 | 35 | 370 |

| | Specific Resistance × $10^{-3}$ (Ω · cm) Heat Treatment | | Crystallinity Heat Treatment | | Moist Heat Resistance | Scuff Resistance |
|---|---|---|---|---|---|---|
| | Before | After | Before | After | $R_1/R_0$ | $R_2/R_0$ |
| Comp. Ex. 1 | 6.3 | 7.1 | Amorphous | Amorphous | 2.1 | 3.5 |
| Comp. Ex. 2 | 3.9 | 5.6 | Amorphous | Amorphous | 1.8 | 2.0 |
| Example 1 | 10.2 | 4.2 | Amorphous | Amorphous | 1.1 | 1.2 |
| Example 2 | 19.7 | 5.0 | Amorphous | Amorphous | 1.0 | 1.1 |
| Example 3 | 60.5 | 5.2 | Amorphous | Amorphous | 1.0 | 1.0 |

Example 4

An ITO film having a thickness of 100 nm was formed on one main surface of a polyethylene terephthalate film

TABLE 2

| | Oxygen Partial Pressure | Electron Mobility ($cm^2/V \cdot sec$) Heat Treatment | | Electron Density $\times 10^{17}$ ($electrons/cm^3$) Heat Treatment | |
|---|---|---|---|---|---|
| | (mPa) | Before | After | Before | After |
| Comp. Ex. 3 | 106 | 10.6 | 9.3 | 572 | 1260 |
| Comp. Ex. 4 | 111 | 22.3 | 18.3 | 1121 | 1196 |
| Example 4 | 117 | 28.5 | 31.0 | 141 | 560 |
| Example 5 | 122 | 28.9 | 31.3 | 54 | 487 |
| Example 6 | 128 | 30.1 | 32.1 | 23 | 219 |

| | Specific Resistance $\times 10^{-3}$ ($\Omega \cdot cm$) Heat Treatment | | Crystallinity Heat Treatment | | Moist Heat Resistance | Scuff Resistance |
|---|---|---|---|---|---|---|
| | Before | After | Before | After | $R_1/R_0$ | $R_2/R_0$ |
| Comp. Ex. 3 | 10.3 | 5.2 | Amorphous | Crystalline | 5.7 | 1.1 |
| Comp. Ex. 4 | 2.5 | 2.9 | Amorphous | Amorphous | 2.1 | 1.8 |
| Example 4 | 15.6 | 3.6 | Amorphous | Amorphous | 1.3 | 1.2 |
| Example 5 | 39.8 | 4.1 | Amorphous | Amorphous | 1.0 | 1.1 |
| Example 6 | 89.4 | 8.9 | Amorphous | Amorphous | 1.0 | 1.1 |

Example 7

The same procedure as in Example 1 was repeated except that a glass (thickness=1 mm) was used as a substrate, thereby preparing a transparent conductive laminate.

Example 8

The same procedure as in Example 2 was repeated except that a glass (thickness=1 mm) was used as a substrate, thereby preparing a transparent conductive laminate.

Example 9

The same procedure as in Example 3 was repeated except that a glass (thickness=1 mm) was used as a substrate, thereby preparing a transparent conductive laminate.

Comparative Example 5

The same procedure as in Comparative Example 1 was repeated except that a glass (thickness=1 mm) was used as a substrate, thereby preparing a transparent conductive laminate.

Comparative Example 6

The same procedure as in Comparative Example 2 was repeated except that a glass (thickness=1 mm) was used as a substrate, thereby preparing a transparent conductive laminate.

Figure 8:
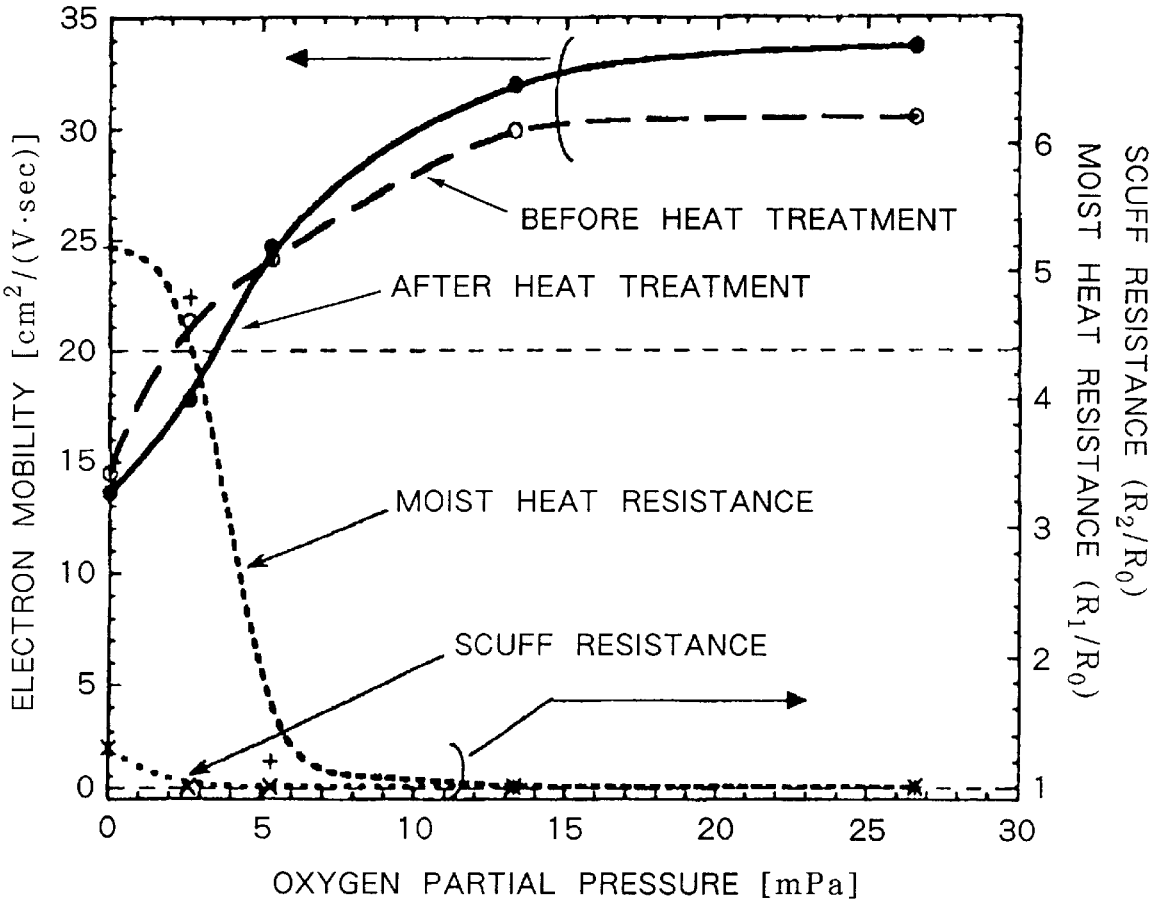
FIG. 8 is a graph showing relations of the electron mobility, the moist heat resistance and the scuff resistance of the ITO film to the oxygen partial pressure at the time of the film formation.

The results of Examples 7 to 9 and Comparative Examples 5 and 6 mentioned above are shown in Table 3. Furthermore, these results in Table 3 are simply shown in the form of a graph in FIG. 8.

TABLE 3

| | Oxygen Partial Pressure | Electron Mobility ($cm^2/V \cdot sec$) Heat Treatment | | Electron Density $\times 10^{17}$ ($electrons/cm^3$) Heat Treatment | |
|---|---|---|---|---|---|
| | (mPa) | Before | After | Before | After |
| Comp. Ex. 5 | 0 | 14.5 | 13.6 | 910 | 800 |
| Comp. Ex. 6 | 2.6 | 21.3 | 17.8 | 770 | 730 |
| Example 7 | 5.3 | 24.1 | 24.7 | 520 | 710 |
| Example 8 | 13.3 | 29.9 | 32.0 | 100 | 550 |
| Example 9 | 26.6 | 30.5 | 33.7 | 40 | 280 |

| | Specific Resistance $\times 10^{-3}$ ($\Omega \cdot cm$) Heat Treatment | | Crystallinity Heat Treatment | | Moist Heat Resistance | Scuff Resistance |
|---|---|---|---|---|---|---|
| | Before | After | Before | After | $R_1/R_0$ | $R_2/R_0$ |
| Comp. Ex. 5 | 4.7 | 5.7 | Amorphous | Crystalline | 5.2 | 1.3 |
| Comp. Ex. 6 | 3.8 | 4.8 | Amorphous | Crystalline | 4.8 | 1.0 |
| Example 7 | 5.0 | 3.5 | Amorphous | Amorphous | 1.2 | 1.0 |
| Example 8 | 10.3 | 3.5 | Amorphous | Amorphous | 1.0 | 1.0 |
| Example 9 | 51.2 | 6.6 | Amorphous | Amorphous | 1.0 | 1.0 |

Examples 10 to 12

The same procedure as in Example 1 was repeated except that a heat treatment temperature was 80° C. (Example 10), 100° C. (Example 11) or 180° C. (Example 12), thereby preparing a transparent conductive laminate.

Comparative Examples 7 to 9

The same procedure as in Example 1 was repeated except that a heat treatment temperature was 50 (Comparative Example 7), 200° C. (Comparative Example 8) or 250° C. (Comparative Example 9), thereby preparing a transparent conductive laminate.

The results of Examples 10 to 12 and Comparative Examples 7 and 9 mentioned above are shown in Table 4.

TABLE 4

| | Heat Treatment Temperature | Electron Mobility ($cm^2/V \cdot sec$) Heat Treatment | | Electron Density $\times 10^{17}$ (electrons/$cm^3$) Heat Treatment | |
|---|---|---|---|---|---|
| | ° C. | Before | After | Before | After |
| Comp. Ex. 7 | 50 | 23.4 | 23.4 | 260 | 260 |
| Example 10 | 80 | 23.4 | 23.8 | 260 | 500 |
| Example 11 | 100 | 23.4 | 24.0 | 260 | 580 |
| Example 1 | 150 | 23.4. | 24.7 | 260 | 600 |
| Example 12 | 180 | 23.4 | 26.8 | 260 | 680 |
| Comp. Ex. 8 | 200 | 23.4 | 15.3 | 260 | 980 |
| Comp. Ex. 9 | 250 | 23.4 | — | 260 | — |

| | Specific Resistance $\times 10^{-3}$ ($\Omega \cdot cm$) Heat Treatment | | Crystallinity Heat Treatment | | Moist Heat Resistance | Scuff Resistance |
|---|---|---|---|---|---|---|
| | Before | After | Before | After | $R_1/R_0$ | $R_2/R_0$ |
| Comp. Ex. 7 | 10.2 | 10.2 | Amorphous | Amorphous | 1.5 | 1.1 |
| Example 10 | 10.2 | 5.3 | Amorphous | Amorphous | 1.2 | 1.1 |
| Example 11 | 10.2 | 4.9 | Amorphous | Amorphous | 1.0 | 1.0 |
| Example 1 | 10.2 | 4.2 | Amorphous | Amorphous | 1.0 | 1.0 |
| Example 12 | 10.2 | 3.4 | Amorphous | Amorphous | 1.0 | 1.0 |
| Comp. Ex. 8 | 10.2 | 4.2 | Amorphous | Crystalline | 3.6 | 1.1 |
| Comp. Ex. 9 | 10.2 | — | The transparent conductive laminate was deformed. | | | |

Example 13

The same procedure as in Example 1 was repeated except that, prior to the formation of a transparent conductive layer, a nickel-chromium alloy thin film (weight ratio=50:50) having a thickness of 0.05 nm was formed on a substrate by a sputtering process, thereby preparing a transparent conductive laminate.

Example 14

Next, electroluminescence light-emitting elements were prepared by the use of some of the transparent conductive laminates prepared in the above-mentioned examples and comparative examples in accordance with the following procedure.

On the transparent conductive layer of each transparent conductive laminate, a light-emitting layer and a dielectric layer having the following compositions, respectively, were formed by a coating method, and they were then dried at 120° C. for 12 hours to remove the used solvent. In forming the light-emitting layer and the dielectric layer, a part of the surface of the transparent conductive layer was left as it was, for the formation of an electrode terminal. Lastly, the dielectric layer was coated with a carbon paste, followed by drying, to form a back surface electrode, thereby preparing the electroluminescence light-emitting element. An AC power source of 100 V and 400 Hz containing no DC component was connected between the transparent conductive layer and the back surface electrode, and an electric field was then applied thereto, whereby light was emitted.

Composition of the coated light-emitting layer
- Zinc sulfide: 50 g
- Copper: 0.5 g
- Cyanoethyl cellulose: 3 g
- Propylene carbonate (solvent): 10 g Composition of the coated dielectric layer
- Barium titanate: 50 g
- Cyanoethyl cellulose: 10 g
- Propylene carbonate (solvent): 30 g Light was emitted from the obtained electroluminescence light-emitting elements by the use of an AC power source containing no DC component and having a voltage of 100 V (an effective value) and a frequency of 400 Hz, and light-emitting durability and flexibility were then evaluated by the following procedures.

(5) Light-emitting durability:

Light was emitted from each electroluminescence light-emitting element under an atmosphere of 40° C. and a humidity of 90%, and an initial light-emitting luminance $I_0$ ($cd/m^2$) was measured by the use of a luminance meter LS-110 made by Minolta Co., Ltd. The light emission was continued, and a light-emitting luminance I ($cd/m^2$) to a light emission time was measured. A time taken to attain a light-emitting luminance change ratio $I/I_0$=0.5 was measured as a light-emitting durability time.

(6) Flexibility resistance:

The electroluminescence light-emitting element was wound around a column, while the light was emitted from the element, and a light-emitting state was observed. If the light-emitting state was not abnormal, the radius of the column was gradually reduced and the observation was repeated. The minimum radius which permitted the acquisition of the uniform light-emitting state was regarded as a flexibility resistance radius (mm).

The results are shown in Table 5.

TABLE 5

| | Oxygen Partial Pressure (mPa) | Middle Layer | Light-Emitting Durability Time (hr) | Flexibility Resistance Radius (mm) |
|---|---|---|---|---|
| Comp. Ex. 2 | 2.7 | Absent | 120 | 10 |
| Example 2 | 13.3 | Absent | 350 | 10 |
| Example 13 | 13.3 | Present | 320 | 6 |
| Example 3 | 26.6 | Absent | 400 | 10 |

Furthermore, the light was emitted from the electroluminescence light-emitting element by the use of a sine-wave power source (a DC component-containing power source) having a voltage of 200 V (a peak value) and a frequency of 400 Hz and containing a DC component in which the back surface electrode was used as a positive pole and the transparent conductive layer was used as a negative pole. The results are shown in Table 6.

TABLE 6

| | Oxygen Partial Pressure (mPa) | Target | Light-Emitting Durability Time (hr) |
|---|---|---|---|
| Comp. Ex. 2 | 2.7 | Oxides | 19 |
| Example 2 | 13.3 | Oxides | 221 |
| Example 3 | 26.6 | Oxides | 271 |
| Comp. Ex. 3 | 106 | Alloy | 13 |
| Example 5 | 122 | Alloy | 211 |
| Example 6 | 128 | Alloy | 253 |

As described above, a transparent conductive laminate according to the present invention is excellent in moist heat resistance and scuff resistance, and when this laminate is used as a transparent electrode, the deterioration of a light-emitting luminance of a light-emitting element by continuous light emission can be remarkably controlled, so that the electroluminescence light-emitting element having an excellent light-emitting durability can be provided.

What is claimed is:

1. An electroluminescence light-emitting element comprising:

a transparent substrate;

a transparent conductive laminate formed on one main surface of said transparent substrate;

a light-emitting layer containing at least zinc sulfide being formed on a conductive surface of said transparent conductive laminate; and a back surface electrode formed on said light-emitting layer, wherein said transparent conductive laminate is an amorphous transparent conductive layer mainly comprising indium, tin and oxygen, wherein said transparent conductive layer formed under a high oxygen concentration atmosphere by a sputtering process, and wherein said transparent conductive layer having a resistivity which changes from being in excess of $1\times10^{-2}$ Ω·cm, to being $1\times10^{-2}$ Ω·cm or less after a heat treatment, while maintaining an amorphous state, whereby the electroluminescence light-emitting element has a half-luminance period of 200 hours or longer when driven by an AC power source of 100 V and 400 Hz in an atmosphere of 40° C. and 90% relative humidity.

2. The electroluminescence light-emitting element according to claim 1 wherein said transparent conductive layer has an electron mobility of 20 $cm^2/(V\cdot sec)$ or more and after the transparent conductive layer is subjected to a heat treatment, its electron mobility is 20 $cm^2/(V\cdot sec)$ or more.

3. The electroluminescence light-emitting element according to claim 2 wherein said transparent substrate is a transparent molded article of a polymer.

4. The electroluminescence light-emitting element according to claim 2 which is driven by applying AC on which a DC component is superposed.

5. The electroluminescence light-emitting element according to claim 1 wherein said transparent conductive layer increases its electron density after being subjected to the heat treatment.

6. The electroluminescence light-emitting element according to claim 5 wherein said transparent substrate is a transparent molded article of a polymer.

7. The electroluminescence light-emitting element according to claim 5 which is driven by applying AC on which a DC component is superposed.

8. The electroluminescence light-emitting element according to claim 1 wherein a metal thin layer is formed between said transparent substrate and said transparent conductive layer.

9. The electroluminescence light-emitting element according to claim 8 wherein said transparent substrate is a transparent molded article of a polymer.

10. The electroluminescence light-emitting element according to claim 8 which is driven by applying AC on which a DC component is superposed.

11. The electroluminescence light-emitting element according to claim 1 wherein said heat treatment is carried out in the range of 80° C. to 180° C. in the air, in a nitrogen atmosphere or in vacuo.

12. The electroluminescence light-emitting element according to claim 11 wherein said transparent substrate is a transparent molded article of a polymer.

13. The electroluminescence light-emitting element according to claim 11 which is driven by applying AC on which a DC component is superposed.

14. The electroluminescence light-emitting element according to claim 1 wherein said transparent substrate is a transparent molded article of a polymer.

15. The electroluminescence light-emitting element according to claim 1 which is driven by applying AC on which a DC component is superposed.

16. An electroluminescence light-emitting element according to claim 1, wherein said AC power source contains no DC component.

17. An electroluminescence light-emitting element according to claim 1, wherein said AC power source contains a DC component.

18. An electroluminescence light-emitting element comprising:

a transparent substrate;

a transparent conductive laminate formed on one main surface of said transparent substrate;

a light-emitting layer containing at least zinc sulfide being formed on a conductive surface of said transparent conductive laminate; and a back surface electrode formed on said light-emitting layer, wherein said transparent conductive laminate is an amorphous transparent conductive layer mainly comprising indium, tin and oxygen, and wherein said transparent conductive layer having a resistivity which changes from being in excess of $1\times10^{-2}$ Ω·cm, to being $1\times10^{-2}$ Ω·cm or less after a heat treatment, while maintaining an amorphous state.

* * * * *